US006219943B1

(12) United States Patent
Kitchell

(10) Patent No.: US 6,219,943 B1
(45) Date of Patent: Apr. 24, 2001

(54) RESILIENT MOUNTING ARRANGEMENT FOR MOLDBOARD

(75) Inventor: Edward W. Kitchell, Cranston, RI (US)

(73) Assignee: Cives Corporation, Roswell, GA (US)

( * ) Notice: Subject to any disclaimer, the term of this patent is extended or adjusted under 35 U.S.C. 154(b) by 0 days.

(21) Appl. No.: 09/128,995

(22) Filed: Aug. 4, 1998

(51) Int. Cl.[7] ..... E01H 5/04

(52) U.S. Cl. ..... 37/232; 37/236; 172/811; 172/816

(58) Field of Search ..... 37/232, 233, 235, 37/236, 266, 268; 172/810, 811, 816

(56) References Cited

U.S. PATENT DOCUMENTS

| | | | | |
|---|---|---|---|---|
| 520,479 | | 5/1894 | Bunnell | 172/701.3 |
| 2,141,558 | | 12/1938 | Richter | 37/231 |
| 2,234,645 | | 3/1941 | Hetzelt | 37/231 |
| 2,722,066 | | 11/1955 | Wills et al. | 37/234 X |
| 3,160,965 | * | 12/1964 | Walker et al. | 37/232 |
| 3,250,026 | * | 5/1966 | Jocher et al. | 37/232 |
| 3,432,949 | * | 3/1969 | Glesmann | 37/232 X |
| 3,547,203 | | 12/1970 | Jackoboice | 172/816 X |
| 3,587,182 | * | 6/1971 | Hirt | 37/232 |
| 3,650,054 | * | 3/1972 | Hanson | 37/232 |
| 3,793,752 | | 2/1974 | Snyder | 37/234 |
| 3,858,665 | | 1/1975 | Winker | 182/816 |
| 3,883,965 | | 5/1975 | Poirier, Sr. et al. | 172/816 X |
| 3,987,562 | | 10/1976 | Deen et al. | 37/42 R |
| 4,133,392 | | 1/1979 | Freese | 172/816 |
| 4,259,794 | * | 4/1981 | Rath | 37/232 X |
| 4,307,523 | * | 12/1981 | Reissinger et al. | 37/232 X |
| 4,439,939 | | 4/1984 | Blau | 37/231 |
| 4,635,387 | | 1/1987 | Häring | 37/232 |
| 4,907,358 | * | 3/1990 | Moore | 37/232 |
| 4,944,104 | | 7/1990 | Kowalczyk | 37/231 |
| 4,977,841 | * | 12/1990 | Truax | 172/763 X |
| 5,121,562 | * | 6/1992 | Feller | 37/232 X |
| 5,136,795 | | 8/1992 | Rosenberg | 37/231 X |
| 5,167,396 | | 12/1992 | Burba et al. | 248/610 |
| 5,181,574 | | 1/1993 | Dion | 172/816 |
| 5,191,729 | * | 3/1993 | Verseef | 37/232 |
| 5,279,236 | * | 1/1994 | Truax | 172/705 X |
| 5,638,617 | | 6/1997 | Bélanger et al. | 37/270 |
| 5,647,153 | | 7/1997 | Gervais | 37/234 X |
| 5,666,747 | | 9/1997 | MacQueen | 37/231 X |
| 5,697,172 | * | 12/1997 | Verseef | 37/232 |
| 5,703,193 | | 12/1997 | Rosenberg et al. | 528/44 |
| 5,743,032 | * | 4/1998 | Vauhkonen | 37/232 X |
| 5,870,839 | | 2/1999 | Wissmiller | 37/231 |
| 5,924,223 | | 7/1999 | Hone, Jr. | 37/231 |
| 5,960,569 | | 10/1999 | Molstad | 37/231 |
| 6,073,371 | * | 6/2000 | Goos et al. | 37/232 |
| 6,125,559 | | 10/2000 | Mullenhour | 37/232 |

FOREIGN PATENT DOCUMENTS

| | | | | |
|---|---|---|---|---|
| 2004447 | * | 8/1971 | (DE) | 37/232 |
| 3205973 | | 9/1983 | (DE) . | |
| 3205974 | | 9/1983 | (DE) . | |
| 1243526 | * | 9/1960 | (FR) | 37/232 |
| 1255480 | * | 1/1961 | (FR) | 37/232 |
| 1058602 | * | 2/1967 | (GB) | 37/232 |
| 751891 | | 7/1980 | (SU) . | |

OTHER PUBLICATIONS

Brochure "Vibrathane Urethane Elastomers," Uniroyal Chemical Co., Inc.

(List continued on next page.)

*Primary Examiner*—Victor Batson
(74) *Attorney, Agent, or Firm*—Burns, Doane, Swecker & Mathis, LLP

(57) ABSTRACT

A mounting arrangement for a moldboard includes a pair of arms having resilient members which are received within a mounting member. The resilient members enable the arms and the moldboard to pivot about the mounting member in the event that an obstruction is encountered by the moldboard such as during snow and ice removal.

28 Claims, 4 Drawing Sheets

OTHER PUBLICATIONS

List of Suppliers of Urethane Components and Equipment, Uniroyal Chemical Co., Inc., Feb. 1998.

Brochure "Commerical & Municipal Series Snowplows," American Snowplow Corp.

Brochure "Machines and Attachments for Summer and Winter Road Maintenance, UNIMOG 403/406/416 Attachments," Schmidt Engineering & Equipment Co. Ltd.

Brochure "Spring–Loaded Multisection Snow Plow Type MF," Schmidt Engineering & Equipment Co. Ltd.

Brochure "Spring–Loaded Multisection Snow Plow Type MF, Implements for UNIMOG," Schmidt Engineering & Equipment Co. Ltd.

Schmidt News and Views, Schmidt Engineering & Equipment Co. Inc., vol. 3, Issue 2, 1990.

Brochure "Schmidt Plows Keeping Ahead of the Cutting Edge," Schmidt Engineering & Equipment, Inc., Jul. 1992.

Advertisement, "Schmidt Wausau The Most Experienced Team in Snow Removal," Drott Tractor Co., Inc.

Fischer Snowplows brochure, pp. 1–9, Jun. 1995.*

* cited by examiner

RESILIENT MOUNTING ARRANGEMENT FOR MOLDBOARD

FIELD OF THE INVENTION

The present invention relates to devices that are useful for mounting moldboards onto vehicles and more particularly to devices that are useful for mounting moldboards used to remove material such as ice and snow from road surfaces and parking lots where obstructions may likely be encountered.

BACKGROUND AND SUMMARY OF THE INVENTION

Moldboards, such as are conventionally used for snow and ice removal, are well known in the art. Moldboards come in a wide variety of shapes and sizes depending upon the intended use. Some moldboards are relatively small and light and are intended to be mounted on a light domestic truck, i.e., a "pickup truck". Other moldboards are of significantly larger size and weight and are intended for municipal or commercial use. These larger moldboards are typically mounted on large trucks which may also be used for spreading sand or salt.

A concern when using a moldboard to remove snow or ice is how to deal with obstructions occurring on the surface being plowed. Some surfaces are considerably rougher than others and may have numerous obstructions. Objects such as grates and manhole covers, rocks, curbs, etc., provide impediments to the removal of ice and snow and may damage the lower edge of the moldboard. In addition, if an obstruction is large enough, the obstruction may cause significant damage to the moldboard and may bring the vehicle used in the plowing operation to an abrupt halt which may result in injury to the vehicle operator.

Various arrangements have been provided along the bottom edge of a moldboard to deal with obstructions. These arrangements are commonly called "trip mechanisms" and are provided to avoid damage to the moldboard and to the vehicle carrying the moldboard.

A representative trip mechanism is described in U.S. Pat. No. 5,079,866, of Gene Farrell, which was issued on Jan. 14, 1992. In the '866 patent, the trip mechanism has a hinged cutting edge along the bottom of the moldboard with two pivotally mounted linkage members and a trip return spring provided on each end of the moldboard to resiliently maintain the orientation of the cutting edge of the moldboard relative to the surface being plowed. If the cutting edge of the moldboard should encounter an obstruction, the pivotally mounted linkage members act on the plowshoe to cause the moldboard to raise and clear the obstruction. After the moldboard has passed beyond the obstruction, the trip return springs cause the cutting edge to return to its normal orientation and the moldboard returns to its initial position.

A trip mechanism such as is described in the '866 patent or other trip mechanisms provided along the bottom edge of a moldboard used in snow removal provide significant protection against damage to the moldboard or to the surface being plowed. However, the need exists for different or for additional protection for moldboards and for the surfaces being plowed especially in the event that a moldboard should encounter an obstruction above the cutting edge.

Such different or additional protection against obstructions must be economical in design and construction as well as reliable in operation. Preferably, such protection for moldboards against obstructions will have relatively few moving parts and will be resistant to damage from rust or from low temperatures because of the environment in which such mechanism must function.

In view of the above background information, it is an object of the present invention to provide a mounting arrangement for a moldboard which provides protection against obstructions encountered during plowing.

A further object of the present invention is to provide a mounting arrangement for a moldboard providing an improved trip mechanism of high reliability and low complexity.

It is another object of the present invention to provide a mounting arrangement for a moldboard having an improved trip mechanism requiring low maintenance and which is suitable for use in a wet and cold environment.

An additional object of the present invention is to provide a mounting arrangement for a moldboard having an improved trip mechanism capable of preventing or significantly reducing damage to the moldboard or to the vehicle or to the operator when obstructions are encountered by the moldboard during plowing.

The above objects as well as other objects not specifically mentioned are accomplished by a mounting arrangement for a moldboard in accordance with the present invention. The mounting arrangement for a moldboard according to the present invention comprises truss means for connecting the moldboard to a vehicle and arm means for pivotally mounting the moldboard on the truss means. In addition, means are provided for resiliently connecting the arm means to the truss means. In the preferred embodiment of the present invention, the truss means includes a mounting member extending longitudinally along the moldboard, with the arm means including first and second arm members received at the ends of the mounting member. In addition, the means for resiliently connecting the arm means to the truss means preferably includes a urethane member provided at each of the first and second arm members between the arm members and the mounting member. Preferably, the mounting member is square in cross-section and hollow along the entire length of the mounting member to provide openings at each end of the mounting member with the urethane members being square in cross-section and configured to be snugly received within the openings in the mounting member. Preferably, each of the first and second arm members includes a shaft extending perpendicularly from said arm member with one of the urethane members being bound to the shaft of each of the arm members. In the preferred embodiment, a cam member is provided on each shaft to limit the extent of angular movement of the arm member and the moldboard about the mounting member.

In an alternative embodiment, each of the shafts of the first and second arm members is square in cross section whereby pivoting of the arm members and the moldboard about the mounting member causes the urethane members to be compressed inside the mounting member when the moldboard encounters an obstruction.

BRIEF DESCRIPTION OF THE DRAWINGS

The preferred embodiments of the present invention will be described in greater detail with reference to the accompanying drawings, wherein like members bear like reference numerals and wherein.

DETAILED DESCRIPTION

Figure 1:
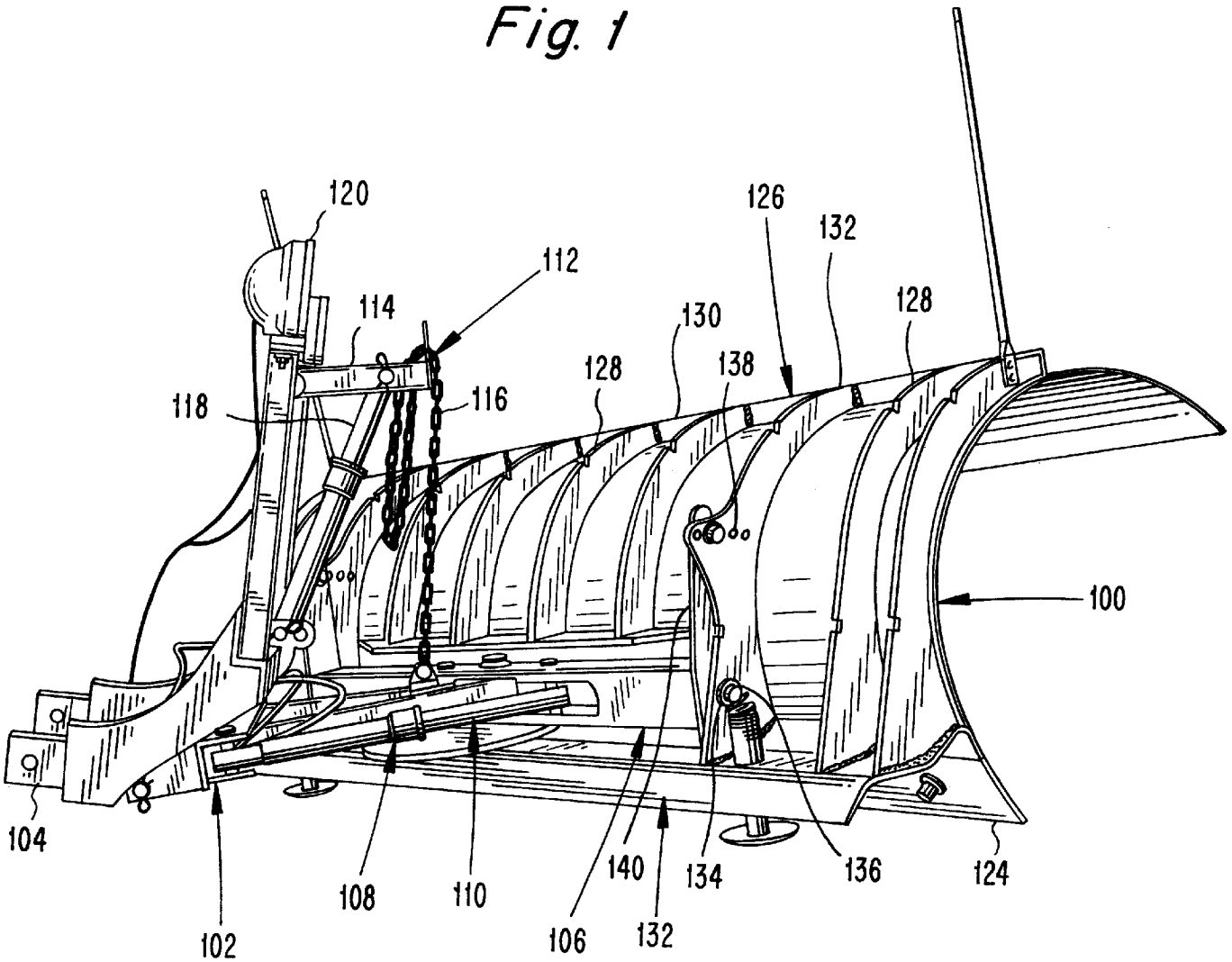
FIG. 1 is a pictorial view of a moldboard according to the present invention.

A preferred embodiment of a mounting arrangement according to the present invention is shown the accompanying drawings. With reference to FIG. 1, a moldboard 100 of conventional design is carried by a truss 102. The truss 102 is arranged to be removably mounted on the front of a truck or other suitable vehicle (not shown) through a bracket 104 in a suitable and conventional manner well known in the art. The truss 102 has a mounting member 106 which is formed from steel square tubing and which comprises a box beam, i.e., a member having a square cross-section, which is hollow along the length of the box beam.

The mounting member 106 is carried on the truss 102 by an A-frame member 108. The mounting member 106 is pivotally attached to the A-frame member 108 at a mid-point of the mounting member 106 with a pair of hydraulic cylinders 110 provided on either side of the A-frame member 108. The hydraulic cylinders 110 are provided to selectively orient the mounting member 106, and therefore to selectively orient the moldboard 100, with respect to the truss 102. In this way, the angle that the moldboard makes with respect to the vehicle may be varied as desired.

In addition, the truss 102 includes an arrangement 112 to lift the moldboard 100 when desired. The arrangement 112 includes a support arm 114 which is pivotally attached to the truss 102. The A-frame member 108 may be attached to the end of the support arm 114 by a chain 116. In addition, the support arm 114 may be raised or lowered by a hydraulic cylinder 118 to raise or lower the A-frame member 108, and thereby raise or lower the moldboard 100.

If desired, the truss 102 may also include headlights 120 to illuminate the roadway in front of the moldboard 100.

If desired, the cutting edge 124 of the moldboard may be made of a flexible or resilient material in order to minimize damage to the moldboard in the event that the cutting edge 124 should strike an obstruction during plowing. The cutting edge 124 may also be provided with a trip mechanism such as is described in U.S. Pat. No. 5,079,866, which is incorporated herein by reference.

The moldboard 100 includes a frame 126 which includes a series of curved support members 128. The support members 128 are connected at their uppermost and lowermost portions to an upper cross member 130 and to a lower cross member 132. Two additional support members 132 are provided adjacent the left and right sides of the moldboard 100 and are provided to connect the moldboard 100 to the truss 102.

The additional support members 132 include a hole 134 which receives a bolt 136 positioned centrally within an end of the mounting member 106. The additional support members 132 also include a series of holes 138 provided at about a midpoint of the frame 126. A pair of arm members 140 formed of steel are carried by the mounting member 106 and the arm members in turn carry the moldboard 100. The series of holes 138 permit the orientation of the moldboard with respect to the arm members 140 to be selectively adjusted.

Figure 2:
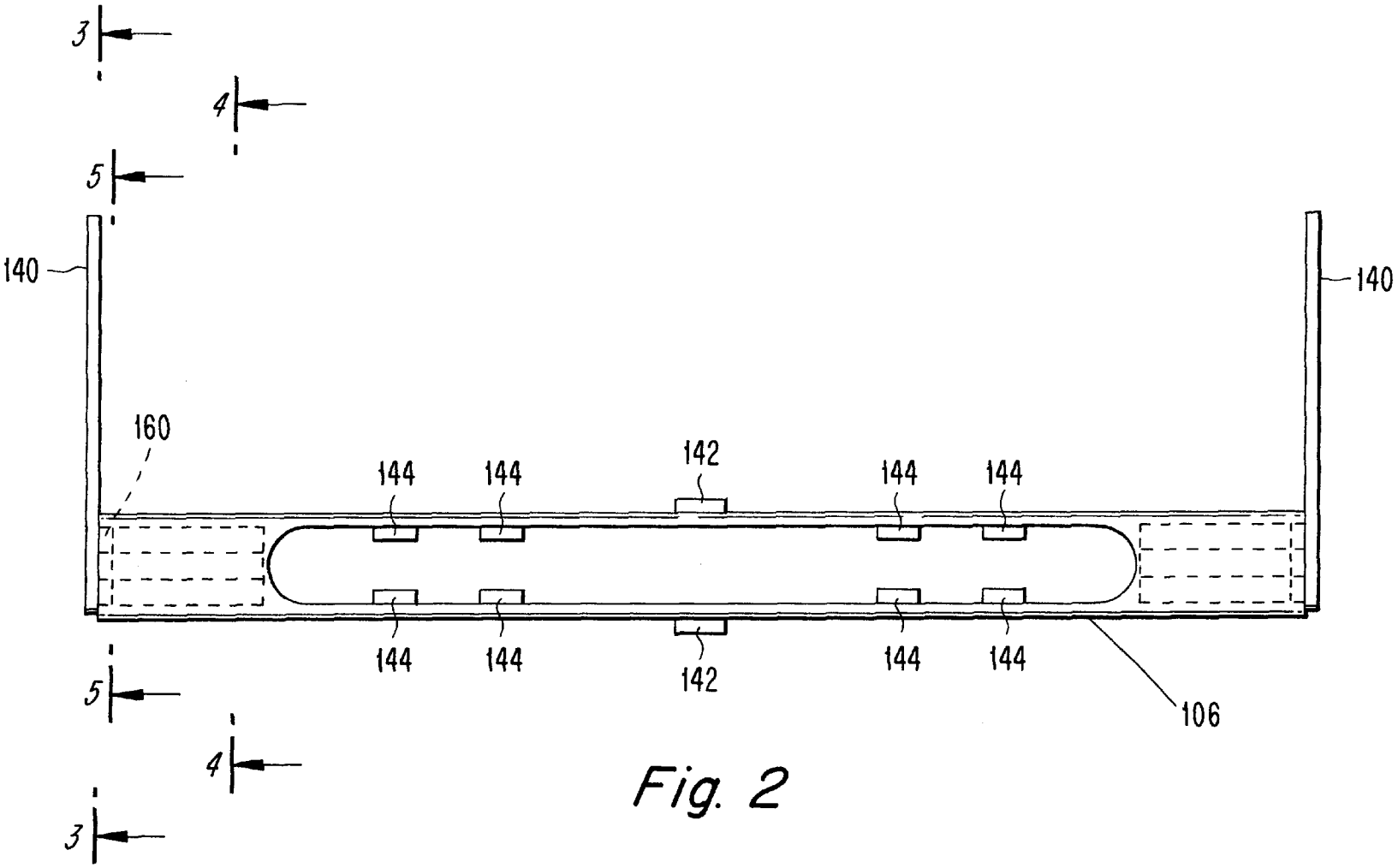
FIG. 2 is a side view of a mounting arrangement for a moldboard according to the present invention.

With reference now to FIG. 2, the mounting member 106 includes a pair of A-frame pivot bearings 142 at a mid-point of the mounting member 106. The mounting member is free to pivot about the pivot bearings 142 with respect to the A-frame member 108 (see FIG. 1). The mounting member 106 also includes a number of power angling bushings 144. The hydraulic cylinders 110 are connected to the mounting member 106 through selected power angling bushings 144.

The mounting member 106 is square in cross section with an opening 146 provided in a side wall of the mounting member 106 adjacent the vehicle to enable the hydraulic cylinders 110 to be connected to the power angling bushings 144.

In a moldboard mounting arrangement according to the prior art (not shown), the arm members 140 have a projection made from steel square tubing which extends at a right angle with respect to the arm member 140. The projection is formed from a rigid box beam having a square configuration in cross-section with the projection sized so as to be snugly received within the ends of the mounting member 106. In the prior art arrangement, the arm members 140 are slidingly received within the mounting member and cannot pivot or rotate with respect to the mounting member 106.

Figure 6:
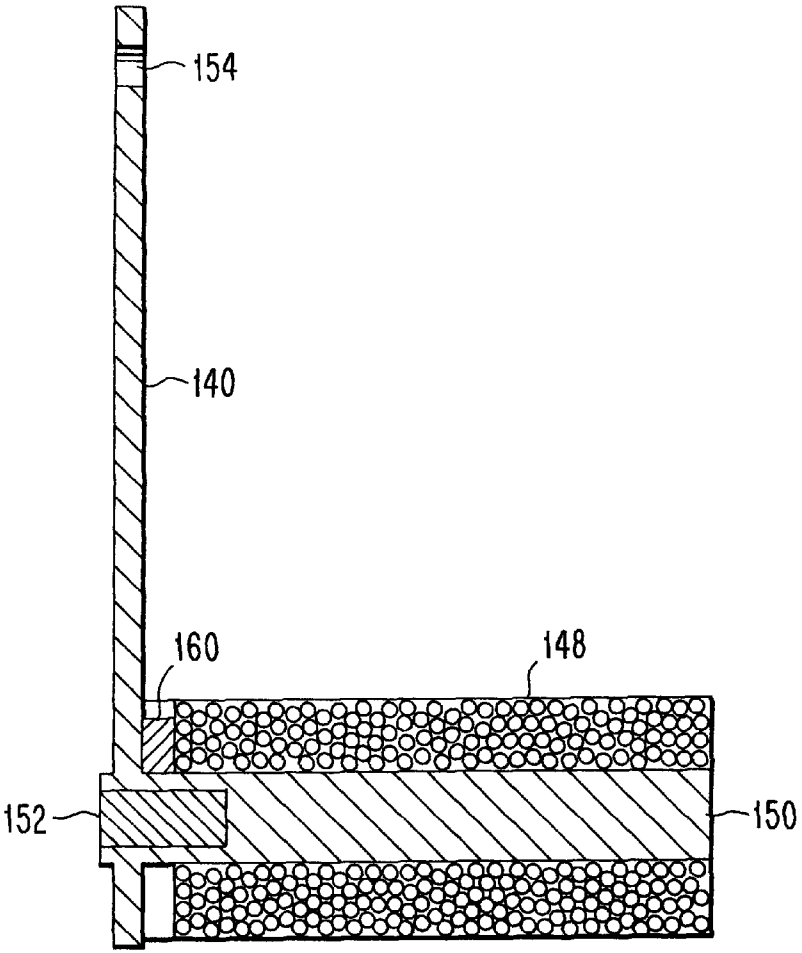
FIG. 6 is a cross sectional view of an arm member and resilient member according to the present invention; and, FIG. 7 is a cross sectional view of another embodiment according to the present invention.

According to the present invention, the arm members 140 are each provided with a resilient member 148 (see FIG. 6). The resilient member 148 has a square cross section and is sized so as to be snugly received within the opening provided at either end of the mounting member 106.

The resilient member 148 enables the arm member 140 to pivot with respect to the mounting member 106. The resilient member 148 preferably has sufficient rigidity to prevent the arm member (and therefore the moldboard) from pivoting about the mounting member 106 during normal operation of the plow in the absence of an obstruction. The flexibility of the resilient member 148 is measured in durometers and a suitable value depends upon the size and weight of the moldboard as well as the flexibility or resiliency desired for the resilient members 148. For a typical moldboard of a light weight to medium weight construction, a durometer of about 330 pounds per linear inch is likely to be suitable, per arm.

In the preferred embodiment, the resilient member is connected to the arm member 140 through a shaft 150. The shaft 150 is either integral with the arm member 140 or is welded to the arm member at one end of the shaft 150. The shaft 150 has a sufficient diameter to enable the shaft to be provided with a threaded opening 152 extending through the arm member 140 to receive the bolt 136 (not shown in FIG. 6, but see FIG. 1). The bolt 136 passes through the lower hole provided in the additional support members 138 of the moldboard frame to connect the moldboard to the arm members. The shaft 150 is preferably centrally located in the resilient member 148 so that the shaft 150 is likewise centrally located in the end of the mounting member 106. In this way, the arm member 140 and the moldboard 100 are arranged to pivot about the shaft 150.

Figure 3:
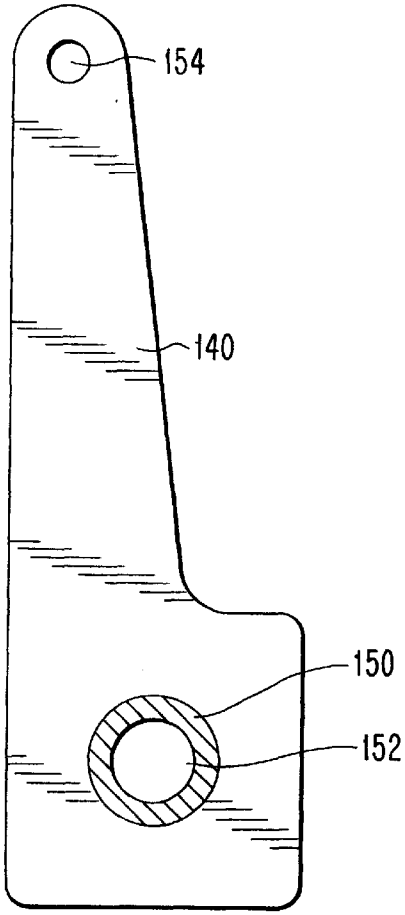
FIG. 3 is a view through the line 3—3 of FIG. 2.

With reference now to FIG. 3, the arm member 140 has the first hole 152 provided in a lower portion of the arm member having a generally square configuration. The arm member 140 includes an upwardly extending portion provided with a second opening 154 which receives a second bolt (see also, FIG. 1) to connect the additional support member 138 to the arm member 140 through one of the series of holes provided in the additional support member at a mid-point of the moldboard 100.

Figure 4:
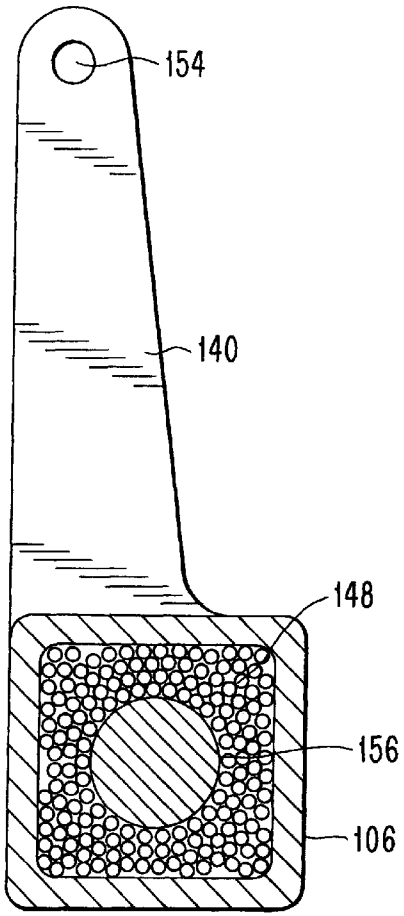
FIG. 4 is a view through the line 4—4 of FIG. 2.

With reference to FIG. 4, the resilient member 148 is snugly received within the square opening provided in the end of the mounting member 106. Because the resilient member 148 is securely bound to the surface of the shaft 156, rotation of the shaft causes a deformation of the resilient member 148 inside the mounting member 106. The extent to which the resilient member resists deformation determines the amount of force needed to rotate the arm member 140 about the shaft 156.

Figure 5:
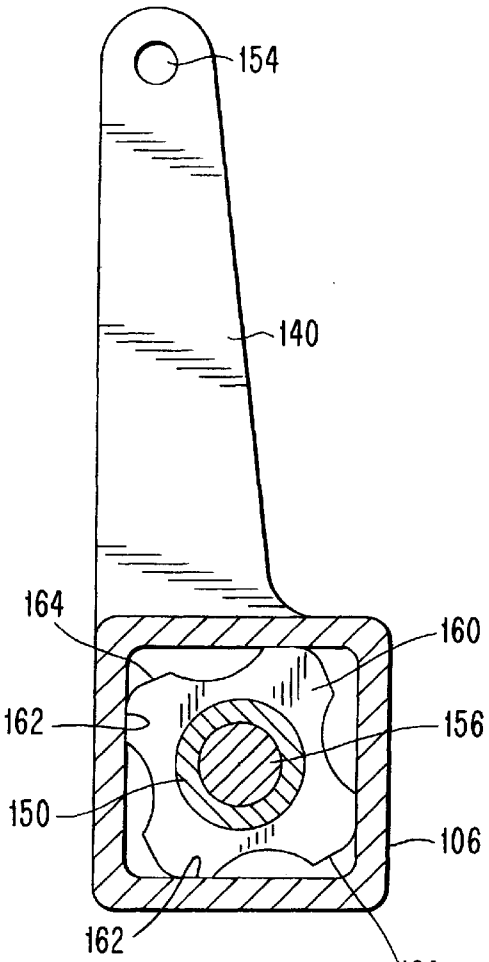
FIG. 5 is a view through the line 5—5 of FIG. 2.

With reference now to FIG. 5, to limit the angular range of motion of the arm member 140 about the shaft 156, the shaft may be provided with a cam member 160. The cam member 160 is fixed with respect to the shaft 150 and with respect to the arm member 140 such as by welding. The cam member 160 has four relatively flat surfaces 162 which contact the inside surface of the mounting member when the arm member 140 is in the rearwardmost position relative to the vehicle. The cam member 160 likewise has four additional relative flat surfaces 164 which abut the inside surface of the mounting member when the arm member 140 has moved sufficiently forward. In this way, the cam member 160 serves to limit the angular extent of movement of the arm member 140 and in turn limit the angular extent of movement of the moldboard 100 about the shaft 156.

The cam member 160 may be welded in the valleys between the flat portions about the perimeter surface of the cam member in order to increase the strength of the cam member.

Preferably, the cam member prevents rotation of the moldboard about the shaft 150 to about 22.5 degrees and usually less than about 35 degrees of rotation in the event that the moldboard encounters an obstruction.

To adjust the ability of the resilient member to oppose a rotation of the moldboard about the shaft 150, the length of the resilient member may be varied as well as the composition of the resilient member. For example, longer and therefore heavier moldboards likely require either longer resilient members 148 or resilient members of a material having a relatively higher durometer.

The mounting arrangement for a moldboard according to the present invention provides significant protection against damage to the moldboard or to the vehicle used for plowing and the vehicle operator (as well as to preventing damage to obstructions) in the event that the moldboard should encounter an obstruction during plowing. However, additional protection is provided when the mounting arrangement according to the present invention is used in conjunction with a conventional trip mechanism for a moldboard for objects and forces above the cutting trip edge.

Figure 7:
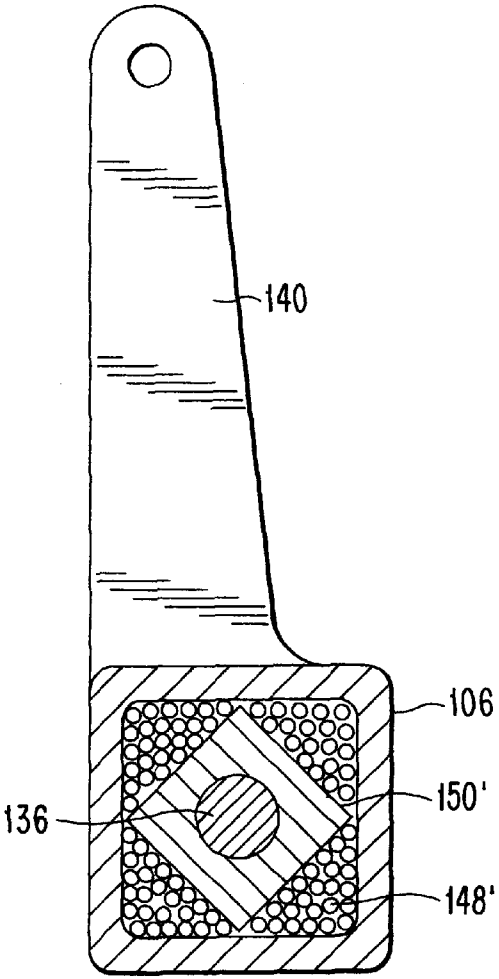

With reference now to FIG. 7, an alternative embodiment is disclosed in which the arm member 140 is provided with a square shaft 150'. The square shaft 150' is welded to the arm member 140 and is oriented so that the corners of the square shaft are adjacent the flat interior surfaces of the mounting member 106 when the arm member 140 is in the rearwardmost position. When the arm member 140 rotates forwardly (such as when the moldboard 100 encounters an obstruction), the flat exterior surfaces of the square shaft 150' compress the resilient member 148' against the inside surfaces of the mounting member 106. In this way, the resistance of the resilient member to being compressed prevents the moldboard 100 from rotating forward about the central axis of the square shaft 150'. As in the embodiment of FIG. 3, the moldboard is connected to the arm member 140 through a bolt 136 which is threadably received by the arm member 140 and by the square shaft 150'. If desired, the arm member 140 of FIG. 7 having a square shaft 150' may also have a cam member 160 (not shown) which operates as described in connection with the embodiment of FIG. 5.

The square shaft 150' may be solid, if desired, or may be hollow depending upon the weight of the moldboard and the thickness of the walls of the square shaft 150'.

The resilient member 148 may be formed of any number of materials readily apparent to one skilled in the art with a suitable material being Adiprene LF 1860A (Adiprene is a trademark of Uniroyal Chemical Company, Inc. of Middlebury, Conn.). Another suitable material is Adiprene LF 1800A. Both Adiprene LF 1800A and Adiprene LF 1860A may be cured with MBCA (4,4'-methylene-bis-(o-chloroaniline)) (MBCA Activator M is available from Miki Sangyo USA, Inc. and MBCA Bis Amine A is available from Omni Spec. Corporation-formerly Palmer Davis Sieka). In addition, when the Adiprene is being cured in a mold, it is preferable (or necessary) to use a mold release such as Mold Release S236 available from Stoner. If the shaft 150 (or the square shaft 150') is to properly bind to the urethane, the surface of the shaft must be prepared. Suitable preparation involves a grit blasting of the shaft using G40 or G50 steel or aluminum oxide 60 mesh at 80–100 p.s.i. In addition, Adiprene Primer Chemlock AP213 or AP218 available from Hughson Chemicals, Division of Lord Corporation, Erie Pa. may be used to facilitate the attachment of the urethane to the shaft.

A suitable process for bonding liquid cast Adiprene to metal surfaces includes the following steps:

1. Degrease metal surfaces with suitable solvent to reduce contamination of grit.
2. Grit blast metal surfaces to be bonded with G40 or G60 steel grit or aluminum oxide-60 mesh at 80–100 p.s.i. air pressure.
3. Degrease metal with solvents; toluene, methyl ethyl ketone, trichloroethylene or perchloroethylene. (Avoid using fast evaporating solvents which may cause moisture condensation on the metal surfaces and result in poor adhesion.) Prepare surfaces just before application of the primer to prevent rusting and contamination. Care should be taken in the selection and application of mold releases to avoid contamination from mold releases on the surfaces intended to be bound to the Adiprene.
4. Apply one or more primer coats and allow to dry.
5. Preheat metal part and mold to about 212 degrees Fahrenheit before casting.
6. Cast mixture of Adiprene prepolymer and crosslinking agent and cure according to manufacturer's instructions.

In operation, a moldboard mounted on a vehicle using the mounting arrangement according to the present invention may be used for plowing material such as ice and snow from a road or other surface. In the event that the moldboard should encounter an obstruction, the resilient material provided about the shaft of the arm members permits the moldboard to pivot forward about 22.5 degrees and preferably less than about 35 degrees to permit the moldboard to pass over the obstruction. In this way, the damage to the moldboard, to the vehicle carrying and moldboard and, most importantly to the operator of the vehicle, from encountering the obstruction is either prevented or significantly reduced.

The principles, preferred embodiments and mode of operation of the present invention have been described in the foregoing specification. However, the invention which is intended to be protected is not to be construed as limited to the particular embodiments disclosed. The embodiments are therefore to be regarded as illustrative rather than as restrictive. Variations and changes may be made without departing from the spirit of the present invention. Accordingly, it is expressly intended that all such equivalents, variations and changes which fall within the spirit and scope of the present invention as defined in the claims be embraced thereby.

What is claimed is:

1. A mounting arrangement for a moldboard comprising:

truss means for connecting a moldboard to a vehicle;

arm means for pivotally mounting the moldboard on the truss means; and means for resiliently connecting the arm means to the truss means, said truss means including a mounting member adapted to extend longitudinally along the moldboard, said mounting member comprising first and second ends, said arm means including first and second arm members received at said ends of said mounting member, and said means for resiliently connecting the arm means to the truss means including a urethane member provided at each of the first and second arm members between the arm members and the mounting member.

2. The mounting arrangement for a moldboard according to claim 1, wherein said first and second arm members each includes means for connecting the arm members to the moldboard at two locations, a first location being provided at said mounting member and a second location being provided remote from said mounting member with said first and second arm members being pivotally mounted on the truss means about said first location.

3. The mounting arrangement for a moldboard according to claim 2, wherein said mounting member has an opening provided at each of said first and second ends of the mounting member and wherein said urethane members are shaped to be received within the openings of said mounting member.

4. The mounting arrangement for a moldboard according to claim 3, wherein said mounting member is square in cross-section and comprises first and second ends and wherein said mounting member is hollow with the openings provided at each of said ends of the mounting member extending along the entire length of the mounting member and wherein said openings are square in cross section, said urethane members being square in cross-section and configured to be snugly received within said openings.

5. The mounting arrangement for a moldboard according to claim 4, wherein said first arm member includes a shaft extending perpendicularly to said first arm member and provided within one of said openings of said mounting member, wherein said second arm member includes a shaft extending perpendicularly to said second arm member and provided within one of said openings of said mounting member, and wherein one of said urethane members is bound to said shaft of said first arm member and one of said urethane members is bound to said shaft of said second arm member.

6. The mounting arrangement for a moldboard according to claim 5, further comprising means for limiting the extent of angular movement of at least one of said first and second arm members and said moldboard about said mounting member.

7. The mounting arrangement for a moldboard according to claim 6, wherein said means for limiting includes at least one cam member which is mounted on the shaft of one of said first and second arm members and received within the respective opening of the mounting member.

8. The mounting arrangement for a moldboard according to claim 7, wherein each of said arm members has a cam member and wherein said cam members limit the angular movement of the arm members and the moldboard to about 22.5 degrees.

9. The mounting arrangement for a moldboard according to claim 8, further comprising a moldboard and wherein said means for connecting each of said arm members to the moldboard at said second location remote from said mounting member includes a plurality of holes provided on said moldboard adjacent the second location of each arm member with a bolt provided through one of said holes of said moldboard and through a hole provided in said arm member whereby the orientation of the moldboard relative to the arm members may be selectively varied.

10. The mounting arrangement for a moldboard according to claim 9, wherein said urethane members are comprised of Adiprene.

11. The mounting arrangement for a moldboard according to claim 7, wherein said cam member limits the angular movement of said one of said first and second arm members and the moldboard to less than about 35 degrees.

12. The mounting arrangement for a moldboard according to claim 5, wherein each of said shafts of said first and second arm members is square in cross section whereby pivoting of the arm members and the moldboard about the mounting member causes the urethane members to be compressed.

13. The mounting arrangement for a moldboard according to claim 5, wherein each of said shafts of said first and second arm members is square in cross section with a flat surface of said shaft oriented adjacent to a corner of said opening in said mounting member when said moldboard is in an initial position, whereby pivoting of the arm members and the moldboard about the mounting member causes the urethane members to be compressed when the moldboard encounters an obstruction.

14. A moldboard and mounting arrangement comprising:

a moldboard;

truss means for connecting the moldboard to a vehicle;

arm means for pivotally mounting the moldboard on the truss means; and means for resiliently connecting the arm means to the truss means, said truss means including a mounting member extending longitudinally along the moldboard, said mounting member comprising first and second ends, said arm means including first and second arm members received at said ends of said mounting member, and said means for resiliently connecting the arm means to the truss means including a urethane member provided at each of the first and second arm members between the arm members and the mounting member.

15. The moldboard and mounting arrangement according to claim 14, wherein said first and second arm members each include means for connecting the arm members to the moldboard at two locations, a first location being provided at said mounting member and a second location being provided remote from said mounting member with said moldboard and mounting arms being pivotally mounted on the truss means about said first location.

16. The moldboard and mounting arrangement according to claim 15, wherein said mounting member has an opening provided at each of said first and second ends of the mounting member and wherein said urethane members are shaped to be received within the openings of said mounting member.

17. The moldboard and mounting arrangement according to claim 16, wherein said mounting member is square in cross-section and comprises first and second ends and wherein said mounting member is hollow with the openings provided at each of said ends of the mounting member extending along the entire length of the mounting member and wherein said openings are square in cross section, said urethane members being square in cross-section and configured to be snugly received within said openings.

18. The moldboard and mounting arrangement according to claim 17, wherein said first arm member includes a shaft extending perpendicularly to said first arm member and provided within one of said openings of said mounting member, wherein said second arm member includes a shaft extending perpendicularly to said second arm member and provided within one of said openings of said mounting member, and wherein one of said urethane members is bound to said shaft of said first arm member and one of said urethane members is bound to said shaft of said second arm member.

19. The moldboard and mounting arrangement according to claim 18, further comprising means for limiting the extent of angular movement of at least one of said first and second arm members and said moldboard about said mounting member.

20. The moldboard and mounting arrangement according to claim 19, wherein said means for limiting includes at least one cam member which is mounted on the shaft of one of said first and second arm members and received within the respective opening of the mounting member.

21. The moldboard and mounting arrangement according to claim 20, wherein said cam member limits the angular movement of said one of said first and second arm members and the moldboard to about 22.5 degrees.

22. The moldboard and mounting arrangement according to claim 21, wherein said means for connecting each of said arm members to the moldboard at said second location remote from said mounting member includes a plurality of holes provided on said moldboard adjacent the second location of each arm member with a bolt provided through one of said holes of said moldboard and through a hole provided in said arm member whereby the orientation of the moldboard relative to the arm members may be selectively varied.

23. The moldboard and mounting arrangement according to claim 22, wherein said urethane members are comprised of Adiprene.

24. The moldboard and mounting arrangement according to claim 23, wherein said cam member limits the angular movement of the arm member and the moldboard to less than about 35 degrees.

25. The moldboard and mounting arrangement according to claim 18, wherein each of said shafts of said first and second arm members is square in cross section whereby pivoting of the arm members and the moldboard about the mounting member causes the urethane members to be compressed.

26. The moldboard and mounting arrangement according to claim 18, wherein each of said shafts of said first and second arm members is square in cross section with a flat surface of said shaft oriented adjacent to a corner of said opening in said mounting member when said moldboard is in an initial position, whereby pivoting of the arm members and the moldboard about the mounting member causes the urethane members to be compressed when the moldboard encounters an obstruction.

27. The moldboard and mounting arrangement according to claim 14, further comprising a trip means provided along a lower edge of said moldboard for enabling the moldboard to pass over obstructions.

28. In a moldboard mounting arrangement for a vehicle having a mounting member which extends longitudinally along the moldboard with first and second arm members slidingly received within openings provided at the ends of the mounting member, said moldboard being carried by the first and second arm members, the improvement wherein said first and second arm members each have a resilient member configured to be snugly received within the openings provided at the ends of the mounting member whereby the arm members and the moldboard may pivot about the mounting member when the moldboard encounters an obstacle.

* * * * *